US005944437A

United States Patent [19]

Heller

[11] Patent Number: 5,944,437

[45] Date of Patent: Aug. 31, 1999

[54] SINGLE USE, DISPOSABLE LOTION APPLICATOR

[76] Inventor: Gary Heller, 807 Topaz Dr., Rockledge, Fla. 32955

[21] Appl. No.: 09/225,057

[22] Filed: Jan. 4, 1999

[51] Int. Cl.[6] ..... B43K 5/14

[52] U.S. Cl. ..... 401/132; 401/196; 15/104.94

[58] Field of Search ..... 401/132, 133, 401/134, 196; 15/104.93, 104.94; 604/3

[56] References Cited

U.S. PATENT DOCUMENTS

| | | | |
|---|---|---|---|
| 2,911,664 | 11/1959 | Zecchini | 401/132 |
| 3,768,916 | 10/1973 | Avery | 401/132 |
| 3,860,348 | 1/1975 | Doyle | 401/132 |
| 4,118,824 | 10/1978 | Clement, Jr. | 15/224 R |
| 4,122,554 | 10/1978 | Stager | 2/164 |
| 4,185,330 | 1/1980 | Stager | 2/164 |
| 4,186,445 | 2/1980 | Stager | 2/164 |
| 5,111,934 | 5/1992 | Morin | 15/104.94 |
| 5,256,417 | 10/1993 | Koltisko | 424/402 |
| 5,484,636 | 1/1996 | Berg, Jr. et al. | 428/40 |
| 5,569,230 | 10/1996 | Fisher et al. | 604/385.1 |
| 5,607,760 | 3/1997 | Roe | 442/375 |
| 5,629,081 | 5/1997 | Richards et al. | 442/96 |
| 5,688,394 | 11/1997 | McBride, Jr. et al. | 15/104.93 |

*Primary Examiner*—David J. Walczak
*Attorney, Agent, or Firm*—John D. Gugliotta, PE, Esq.

[57] ABSTRACT

A single use, disposable lotion applicator comprising an applicator located inside a container. The applicator is filled with lotion. An applicator removal means facilitates easy removal of the applicator from the container. In an alternate embodiment of the present invention, a vial filled with lotion is located inside the applicator.

10 Claims, 4 Drawing Sheets

SINGLE USE, DISPOSABLE LOTION APPLICATOR

RELATED APPLICATIONS AND DISCLOSURES

The present invention was first disclosed in the Disclosure Document filed on Jul. 29, 1998. There have been no previously filed, nor any co-pending applications, anywhere in the world.

BACKGROUND OF THE INVENTION

1. Field of the Invention

The present invention relates generally to lotion applicators, and, more particularly, to a single use, disposable lotion applicator.

2. Description of the Related Art

Many individuals use lotions of various sorts during a typical day. These lotions include suntan lotion, moisturizing lotion and the like. Most lotions are sold in large containers, which are bulky and therefore not conveniently portable. Such containers are fine for use in the bathroom of one's home, but when lotion is needed outside the home setting, the difficulty of carrying the lotion container with one's person arises.

Smaller lotion bottles and containers are available, but these must still be carried by the individual after use. If the user has no pockets, such as when at the beach, then the remainder of the lotion bottle must be wasted, creating an expense for the user and the inconvenience of having to buy another lotion bottle.

What is needed is a single use lotion applicator that is easy to carry. Even still, many single use lotion applicators have a limited shelf life because the lotion inside the single use applicator dries out quickly, especially in direct sunlight. Such an applicator must be easy to open and easy to apply also. To further simplify carrying and usage, the applicator and lotion should be contained in a single disposable package.

In the related art, several devices are disclosed that describe pre-moistened disposable wet wipes. These include U.S. Pat. No. 5,629,081, issued in the name of Richards et. al., U.S. Pat. No. 5,569,230, issued in the name of Fisher et. al., U.S. Pat. No. 5,484,636, issued in the name of Fisher et. al., and U.S. Pat. No. 5,256,417, issued in the name of Koltisko.

U.S. Pat. No. 5,667,760, issued in the name of Roe discloses a disposable diaper pre-moistened in lotion.

Several patents describe a disposable lotion-applicating cosmetic glove. These include U.S. Pat. No. 4,186,445, issued in the name of Stager, U.S. Pat. No. 4,185,330, issued in the name of Stager and U.S. Pat. No. 4,122,554, issued in the name of Stager.

U.S. Pat. No. 4,118,824, issued in the name of Clement, Jr. discloses an applicator having insertable sponge cartridges.

However, these devices fail to address the fact that lotion, when exposed to direct or indirect sunlight or excessive heat, will harden and dry out, becoming useless to the user.

A search of the prior art did not disclose any patents that anticipate directly many features of the instant invention. Consequently, a need has been felt for providing an apparatus and method which overcomes the problems cited above.

SUMMARY OF THE INVENTION

It is therefore an object of the present invention to provide an improved single use, disposable lotion applicator that combines the lotion and applicator in one package with a long shelf-life.

Briefly described according to one embodiment of the present invention, a single use, disposable lotion applicator is disclosed, comprising an applicator located inside a container. The container is sealed with a sealing material and opened via a sealing material opening means.

The applicator is filled with lotion. An applicator removal means facilitates easy removal of the applicator from the container. In an alternate embodiment of the present invention, a vial filled with lotion is located inside the applicator.

It is another object of the present invention to provide a device that contains an easily accessible applicator, lotion and a container to hold both.

It is another object of the present invention to provide a device that is portable, lightweight and small.

It is another object of the present invention to provide a device that will have a long shelf-life.

| DESCRIPTIVE KEY | |
|---|---|
| 10 | single use, disposable lotion applicator |
| 20 | container |
| 30 | applicator |
| 40 | lotion |
| 50 | support material |
| 60 | fingers |
| 70 | applicator removal means |
| 80 | sealing material |
| 90 | sealing material opening means |
| 100 | vial |
| 110 | cavity |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 4.

1. Detailed Description of the Figures

Figure 1:
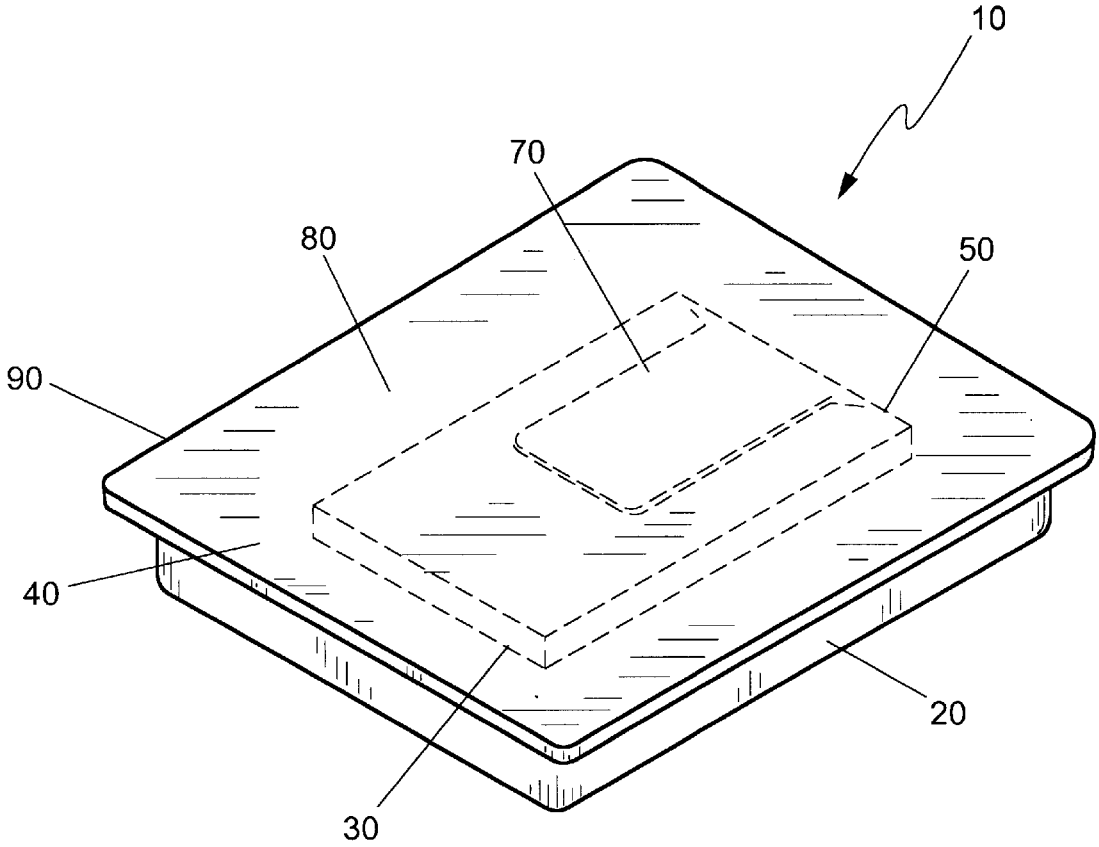
FIG. 1 is a perspective view of the preferred embodiment of single use, disposable lotion applicator 10.
Figure 2:
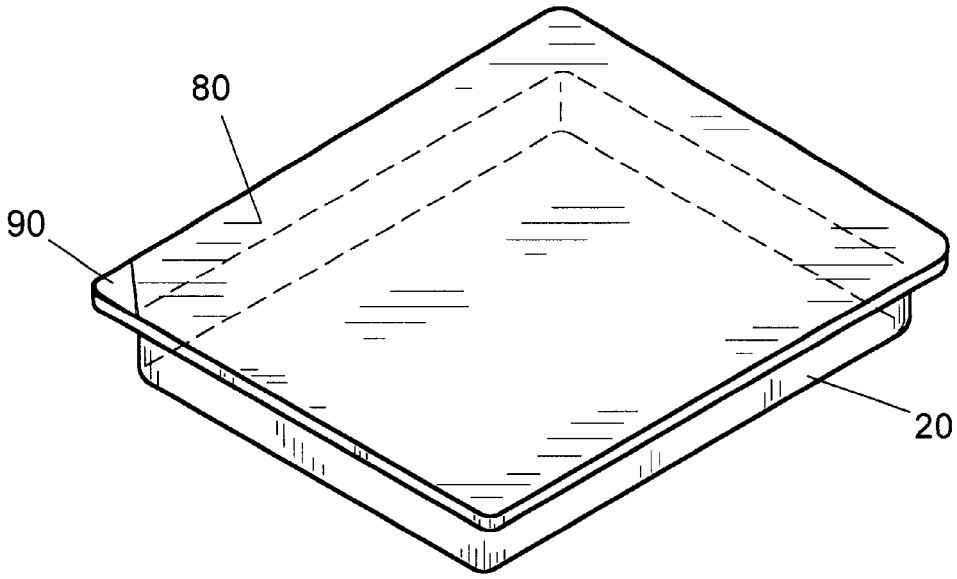
FIG. 2 is a perspective view of the container.

Referring now to FIGS. 1 and 2, a single use, disposable lotion applicator 10 is shown, according to a preferred embodiment of the present invention and comprises a container 20, of a generally rectangular configuration, with a bottom and four short walls, and an open top. It is envisioned that the container 20 is of sufficient small size to fit inside of a person's pocket and is constructed of a material selected from the group comprising polystyrene or plastic.

Figure 3:
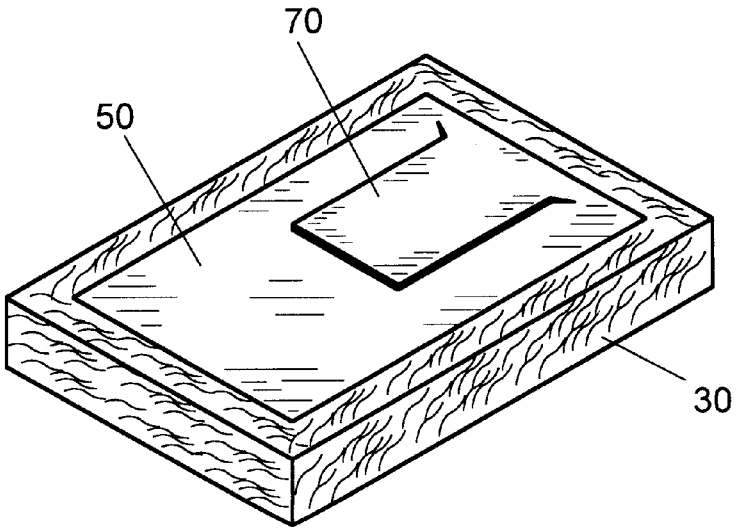
FIG. 3 is a perspective view of the applicator.

Referring now to FIGS. 1 and 3, an applicator 30, of a generally rectangular configuration, similar to the container 20, is disclosed. The applicator 30 is capable of holding within it lotion 40, such as suntan lotion. For purposes of disclosure, the applicator 30 is depicted as a sponge applicator 30. The applicator 30 fits snugly inside of volume of the container 20. The applicator 30 is filled with a lotion 40, evenly distributed throughout the applicator 30.

The upper surface of the applicator 30 is covered by a support material 50. For purposes of disclosure, the support material 50 is depicted as satin or felt.

Figure 4:
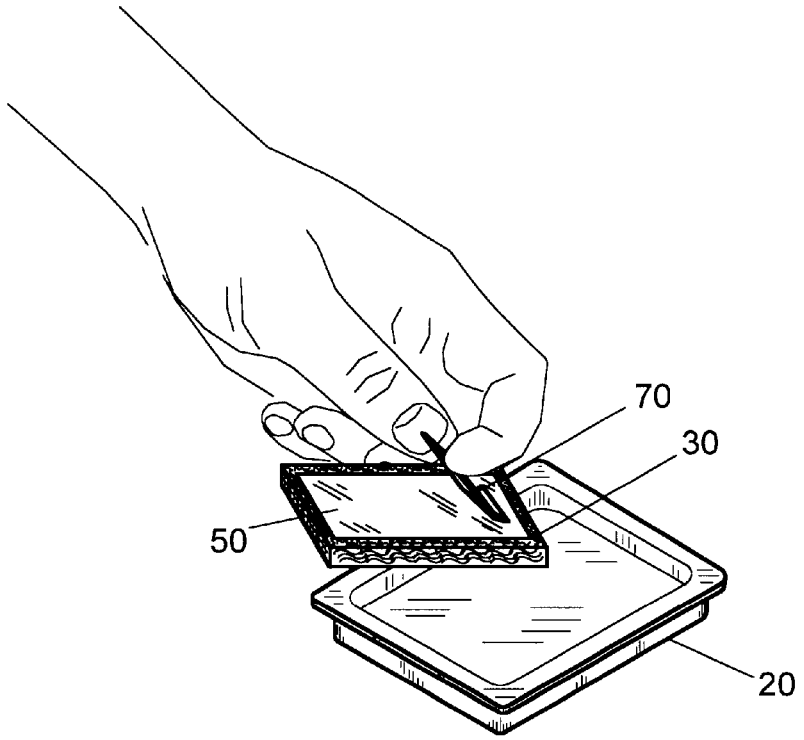
FIG. 4 is a perspective view of the applicator being removed from the container.

Referring now to FIGS. 1, 3 and 4, an applicator removal means 70 is attached to the top surface of the support material 50, and is designed to facilitate easy removal of the applicator 30 from the container 20 by grasping the applicator removal means 70 with one's fingers 60. The applicator removal means 70 also functions as a grasping means to facilitate application of lotion 40 once the applicator 30 is removed from the container 20.

For purposes of disclosure, the applicator removal means 70 is depicted as a pull tab.

Referring now to FIG. 1, the open top of the container 20 is covered with a sealing material 80. For purposes of disclosure, the sealing material 80 is depicted as foil, releasably secured to the top of the container 20.

A sealing material opening means 90 is provided. For purposes of disclosure, the sealing material opening means 90 is depicted as a scored corner of the sealing material 80. Other sealing material opening means 90 are envisioned, including but not limited to sealing material 80 extending outward beyond one or more walls of the container 20, to facilitate easy grasping by a user's fingers 60.

Figure 5:
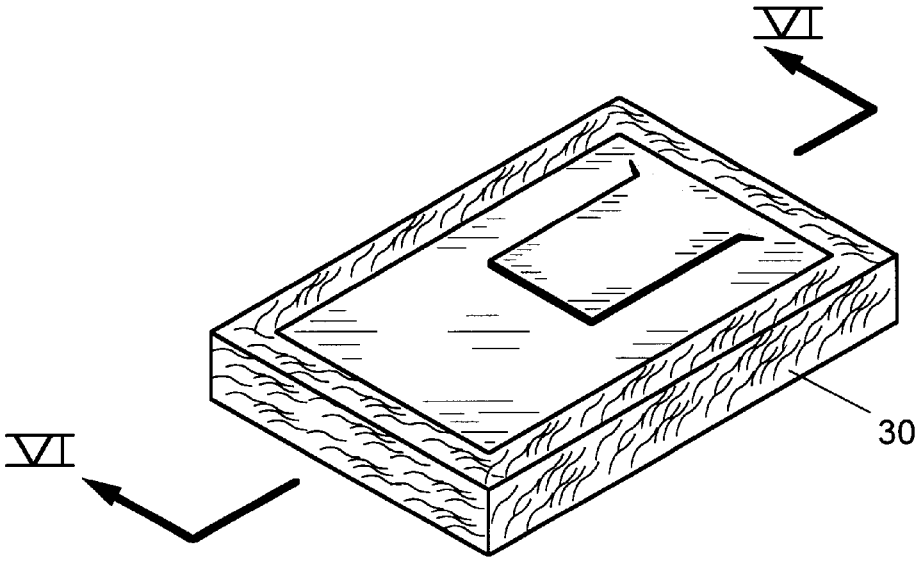
FIG. 5 is a perspective view of an alternate embodiment of the present invention.
Figure 6A:
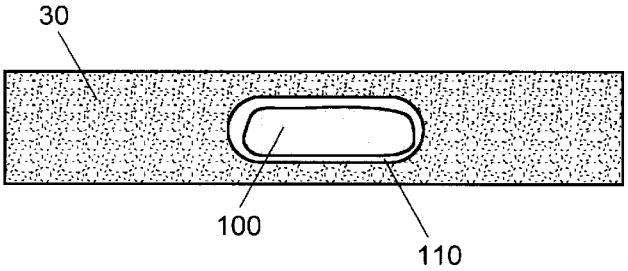
FIG. 6*a*–6*c* are a series of cross sectional views, cut along line VI—VI of FIG. 5, showing how the applicator is prepared for use.

Referring now to FIGS. 5 and 6*a*, in another embodiment of the present invention, a vial 100 filled with lotion 40 is located inside a cavity 110 that is formed inside of the applicator 30.

Figure 6B:
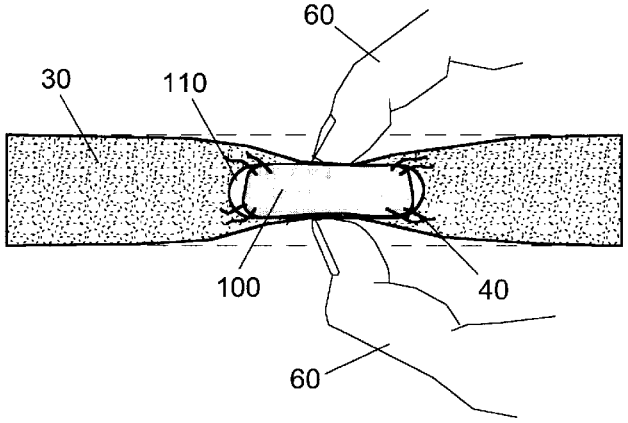

Referring now to FIG. 6*b*, the vial 100 is designed to be easily punctured and collapsed with pressure from a user's fingers 60. The vial 100 may be constructed of any material that would hold the lotion 40 and be easily punctured as a result of external pressure applied by a person, whether sick or well, male or female, child or adult, young or old.

Figure 6C:
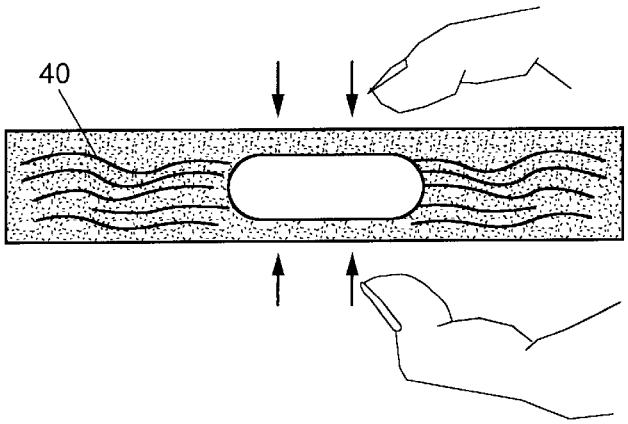

Referring now to FIG. 6*c*, when the vial 100 is punctured, the lotion 40 inside the vial 100 is released into the applicator 30. Squeezing the applicator 30 distributes the lotion 40 throughout the applicator 30. By placing the lotion 40 inside the vial 100, the shelf-life of the lotion 40 is increased.

It is envisioned that other styles and configurations of the container 20, applicator 30, applicator removal means 70, support material 50, sealing material 80 and sealing material opening means 90 can be easily incorporated into the teachings of the present invention, and only one particular configuration shall be shown and described for purposes of clarity and disclosure and not by way of limitation of scope.

2. Operation of the Preferred Embodiment

To use the preferred embodiment of the present invention, pull the sealing material 80 off the top of the container 20 using the sealing material opening means 90. Grasp the applicator removal means 70 and pull the applicator 30 from the container 20. Apply the lotion 40 by either holding the applicator 30 itself or holding the sponge applicator removal means 70 , using it as a grasping means.

To use the embodiment with the vial 100, the container 20 is opened and the sponge applicator 30 is removed the same way as in the preferred embodiment. Once the applicator 30 is removed from the container 20, the user squeezes the middle of the applicator 30, on both the upper surface and bottom surface, squeezing the sponge applicator 30 together vertically. This will rupture the vial 100 filled with the lotion 40. Next, the user squeezes the sponge applicator 30 several times, releasing pressure in between squeezes. This squeezing action distributes the lotion 40 throughout the applicator 30. The applicator 30 is then used in the same way as the preferred embodiment to apply lotion 40.

The foregoing description is included to illustrate the operation of the preferred embodiment and is not meant to limit the scope of the invention. The scope of the invention is to be limited only by the following claims.

What is claimed is:

1. A single use, disposable lotion applicator comprising:

a container, of a generally rectangular configuration, with a bottom and four short walls, and an open top;

an applicator, of a generally rectangular configuration, similar to said container, said applicator designed to fit snugly inside a volume of said container;

lotion, said lotion evenly distributed throughout said applicator;

a support material, said support material covering an upper surface of said applicator;

applicator removal means, said applicator removal means attached to the top surface of said support material, and is designed to facilitate easy removal of said applicator from said container;

sealing material, said sealing material covering said open top of said container; and sealing material opening means, said sealing material opening means designed for easy opening of said sealing material.

2. The single use, disposable lotion applicator described in claim 1, wherein said container is of sufficient small size to fit inside of a person's pocket.

3. The single use, disposable lotion applicator described in claim 1, wherein said applicator removal means also functions as a grasping means to facilitate application of lotion once said applicator is removed from said container.

4. The single use, disposable lotion applicator described in claim 1, wherein said applicator removal means is a pull tab.

5. The single use, disposable lotion applicator described in claim 1, wherein said support material is felt.

6. The single use, disposable lotion applicator described in claim 1, wherein said applicator is made from a sponge or sponge type material.

7. The single use, disposable lotion applicator described in claim 1, wherein said present invention has an extended shelf life.

8. A single use, disposable lotion applicator comprising:

a container, of a generally rectangular configuration, with a bottom and four short walls, and an open top;

an applicator, of a generally rectangular configuration, similar to said container, said applicator designed to fit snugly inside a volume of said container;

a cavity, said cavity formed inside said applicator;

a vial, said vial located inside said cavity, said vial being easily ruptured;

lotion, said lotion located inside said vial;

a support material, said support material covering an upper surface of said applicator;

applicator removal means, said applicator removal means attached to the top surface of said support material, and is designed to facilitate easy removal of said applicator from said container;

sealing material, said sealing material covering said open top of said container; and sealing material opening means, said sealing material opening means designed for easy opening of said sealing material.

9. The single use, disposable lotion applicator described in claim 8, wherein said applicator is made from a sponge or sponge type material.

10. The single use, disposable lotion applicator described in claim 8, wherein said present invention has an extended shelf life.

* * * * *